US007297852B1

(12) United States Patent
Chen

(10) Patent No.: US 7,297,852 B1
(45) Date of Patent: Nov. 20, 2007

(54) PEDAL DEVICE FOR A DRUM

(76) Inventor: Kuo-Chang Chen, No. 32, Doutan Rd., Shalu Chen, Taichung Hsien (TW)

( * ) Notice: Subject to any disclaimer, the term of this patent is extended or adjusted under 35 U.S.C. 154(b) by 0 days.

(21) Appl. No.: 11/511,729

(22) Filed: Aug. 29, 2006

(51) Int. Cl.
*G10D 13/02* (2006.01)

(52) U.S. Cl. ..... 84/422.1

(58) Field of Classification Search ..... 84/422.1–422.3
See application file for complete search history.

(56) References Cited

U.S. PATENT DOCUMENTS 6,137,040 A * 10/2000 Hoshino ..... 84/422.1
2003/0047060 A1* 3/2003 Cocca ..... 84/422.1

* cited by examiner

*Primary Examiner*—Kimberly Lockett
(74) *Attorney, Agent, or Firm*—Alan Kamrath; Kamrath & Associates P.A.

(57) ABSTRACT

A pedal device for playing a drum has a base, two posts, a shaft, an arm, a drumstick, a pedal, a spring, a sling hook and a connection member. The posts are mounted on the base. The shaft is mounted rotatably between the post and has two ends. The arm is mounted on one end of the shaft. The drumstick is attached securely to and perpendicularly extends out from the shaft. The sling hook hooks on arm. The connection member is mounted on the base. A diameter of the spring gradually is shortened at two ends of the spring, which forms two mounting portions. Each of the sling hook and the connection member has a knob formed thereon. The knobs are coaxially embedded respectively in the mounting portions of the spring. A pulling force on the spring distributed uniformly, so the pedal device can be treaded smoothly.

3 Claims, 6 Drawing Sheets

PEDAL DEVICE FOR A DRUM

BACKGROUND OF THE INVENTION

1. Field of the Invention

The present invention relates to a pedal device for a drum, and particularly relates to a pedal device that is treaded smoothly.

2. Description of the Related Art

With reference to FIG. 6, a conventional pedal device has a base (40), two posts (41) are provided on the base (40), and a shaft (42) is mounted rotatably between the two posts (41) and has two ends. One end of the shaft (42) is mounted through and protrudes out from a corresponding post (41), and an arm (43) is provided on the protruding end of the shaft (42). A wheel (431) is mounted rotatably on the arm (43), and a sling hook (432) is hung on the wheel (431). A seat (411) is formed at a bottom of the post (41) corresponding to the arm (43), and a connection member (44) is mounted through the seat (411). A spring (45) is provided between the sling hook (432) and the connection member (44) and has a top end, a bottom end and two hooks (451). The hooks (451) are formed respectively on the top and bottom end, deviate from a central axis of the spring (45) and respectively hook on the sling hook (432) and the connection member (44).

A sway member (46) is mounted in a middle of the shaft (42), and a drumstick (47) extends from the top of the sway member (46), in a direction that is perpendicular to the shaft (42). A chain (48) is provided along the sway member (46), and a distal end of the chain (48) is connected with a pedal (49). The pedal (49) is connected pivotally with the base (40).

However, the hooks (451) deviating from the central axis of the spring results in that the spring (45) incompletely stretch along its central axis when the pedal (49) is stepped down. The incomplete stretch of the spring (45) makes a performer stepping the pedal (49) feel un-smooth.

Therefore, the invention provides a pedal device for a drum to mitigate or obviate the aforementioned problems.

SUMMARY OF THE INVENTION

The main objective of the present invention is to provide a pedal device for a drum that is treaded smoothly.

A pedal device for playing a drum in accordance with the present invention has a base, two posts, a shaft, an arm, a drumstick, a pedal, a spring, a sling hook and a connection member. The posts are mounted on the base. The shaft is mounted rotatably between the post and has two ends. The arm is mounted on one end of the shaft. The drumstick is attached securely to and perpendicularly extends out from the shaft. The sling hook hooks on arm. The connection member is mounted on the base. A diameter of the spring gradually is shortened at two ends of the spring, which forms two mounting portions. Each of the sling hook and the connection member has a knob formed thereon. The knobs are coaxially embedded respectively in the mounting portions of the spring.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
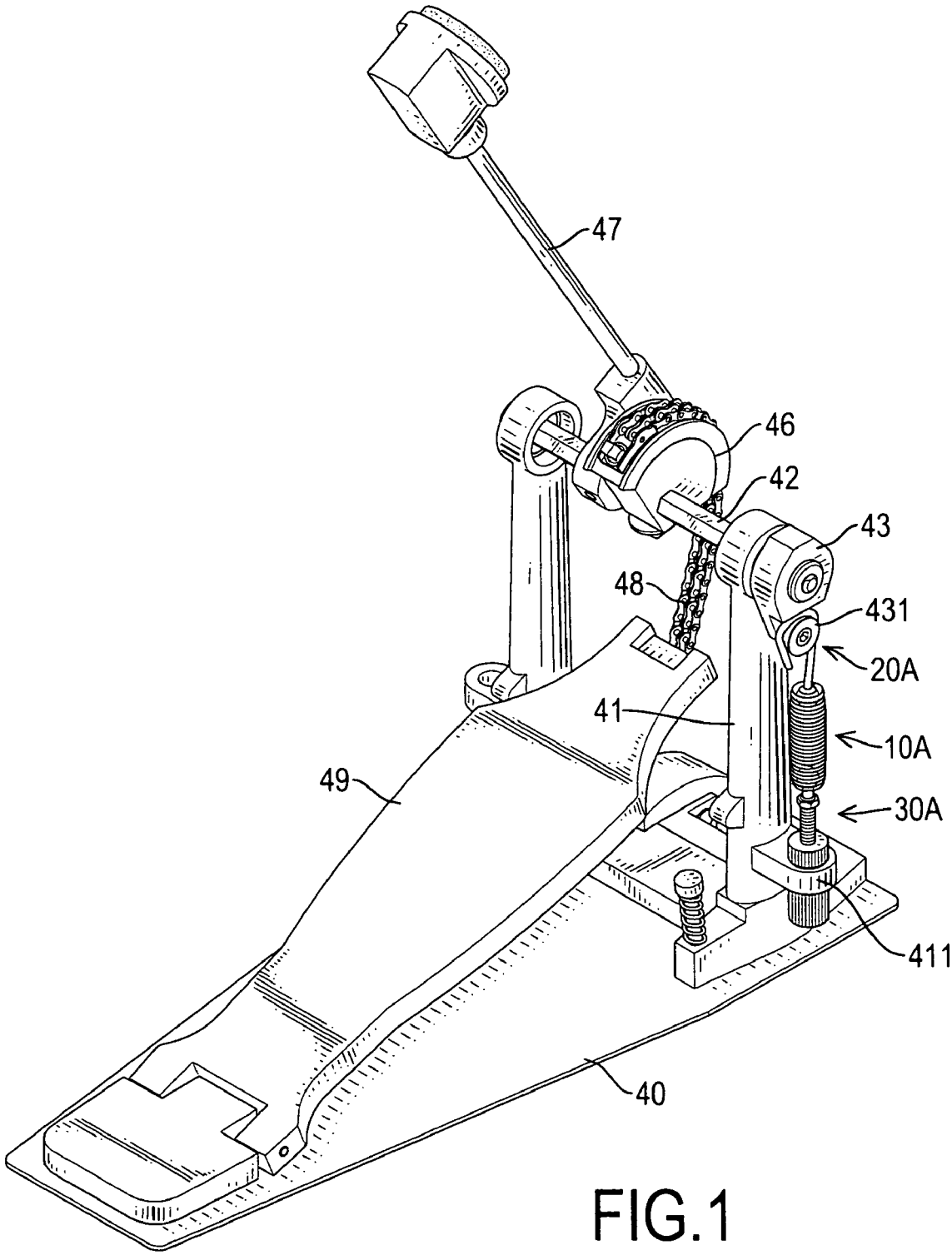
FIG. 1 is a perspective view of a first embodiment of a pedal device in accordance with the present invention.
Figure 2:
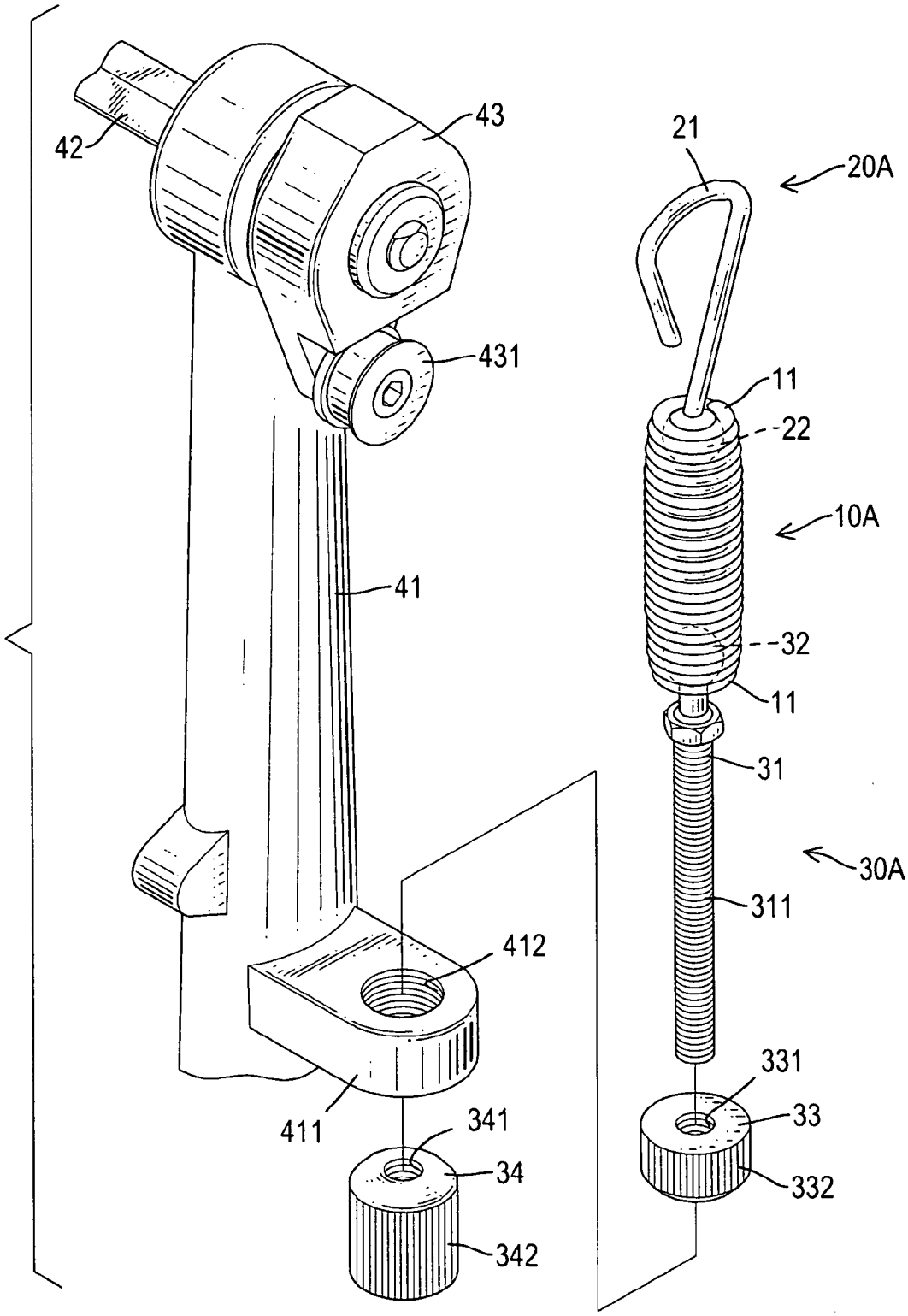
FIG. 2 is an exploded perspective view of the pedal device in FIG. 1.
Figure 3:
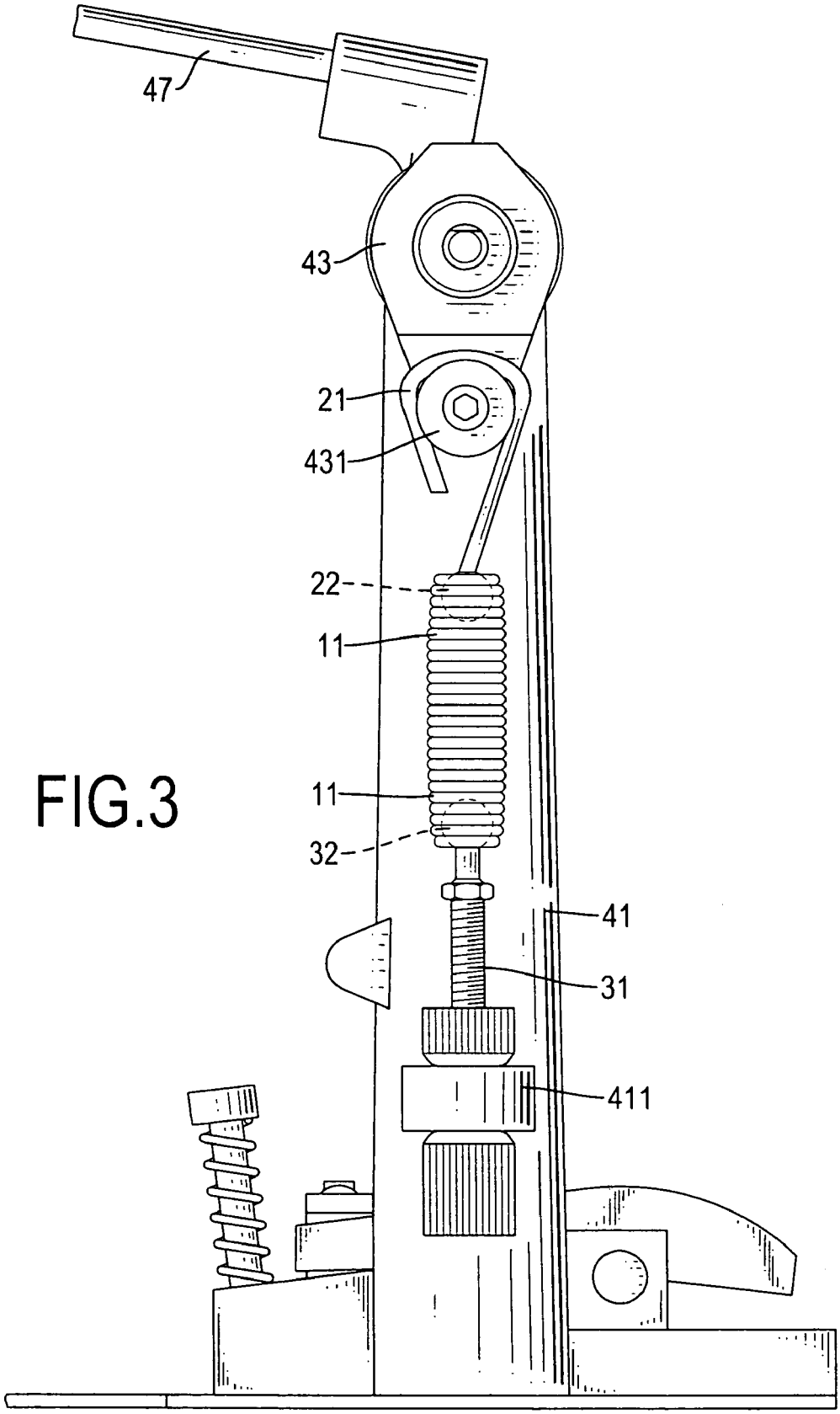
FIG. 3 is a side view of the pedal device in FIG. 1.

With reference to FIGS. 1-3, a pedal device in accordance with the present invention is used to play a drum. A first embodiment of the pedal device in accordance with the present invention comprises a base (40), two posts (41) are mounted on the base (40). A shaft (42) is mounted rotatably between the two posts (41) and has two ends. One end of the shaft (42) is a protruding end mounted through and protruding out from a corresponding post (41), and an arm (43) is mounted on the protruding end of the shaft (42). A wheel (431) is mounted rotatably on the arm (43). A seat (411) is formed at a bottom of the post (41) corresponding to the arm (43). A sway member (46) is mounted in a middle of the shaft (42). A drumstick (47) extends from the top of the sway member (46) and is perpendicular to the shaft (42). A chain (48) is mounted on the sway member (46) and has a distal end. The pedal (49) is connected with the distal end of the chain (48) and is mounted pivotally with the base (40).

A spring (10A) has an upper end and a lower end. A diameter of the spring (10A) is shortened gradually at the upper and lower ends, which forms two mounting portions (11).

A sling hook (20A) hooks on the wheel (431) and is connected with the upper end of the spring (10A). The sling hook (20A) includes a hook member (21) and a first knob (22). The hook member (21) hooks around the wheel (431). The first knob (22) is embedded in mounting portion at the upper end of the spring (10A) and is clasped by the mounting portion (11).

A connection member (30A) is mounted on the seat (411) and is connected with the lower end of the spring (10A). The connection member (30A) includes a threaded screw bolt (31), which has a second knob (32) formed on a top of the screw bolt (31), and the second knob (32) is embedded in the lower end of the spring (10A) and is clasped by the mounting portion (11). An upper nut (33) has a first threaded hole (331) defined in a center of the upper nut (33), and engaged with the screw bolt (31), the upper nut (33) has multiple first anti-slip ribs (332). A lower nut (34) has a second threaded hole (341) defined in a center of the lower nut (34) and engaged with the screw bolt (31, below the upper nut (33) and has multiple second anti-slip ribs (342).

When the pedal device is assembled, the hook member (21) of the sling hook (20A) hooks on the wheel (431), and the screw bolt (31) is mounted through a threaded hole (412) defined in the seat (411). The upper nut (33) and the lower nut (34) are mounted onto the screw bolt (31) and are located respectively at two sides of the seat (411) to securely mount the connection member (30A) on the seat (411). When a performer treads the pedal (49) and knocks the drum with the drumstick (47), the arm (43) will be pivotally pulled, and the wheel (431) is driven to rotate, and the sling hook (20A) pulls the spring, which further generates a sway force.

The design of the knobs (22), (32) embedded coaxially in the upper and lower ends of the spring (10A) makes a pulling force on the spring (10A) lying on a central axis of the spring (10A) and distributed uniformly so the knobs (22), (23) can pull the spring (10A) smoothly. Also, the spring (10A) recovers with its recovery force lying on the central axis of the spring (10A). Therefore, the performer treading the pedal to play the drumstick (47) feel smooth and comfortable.

Figure 4:
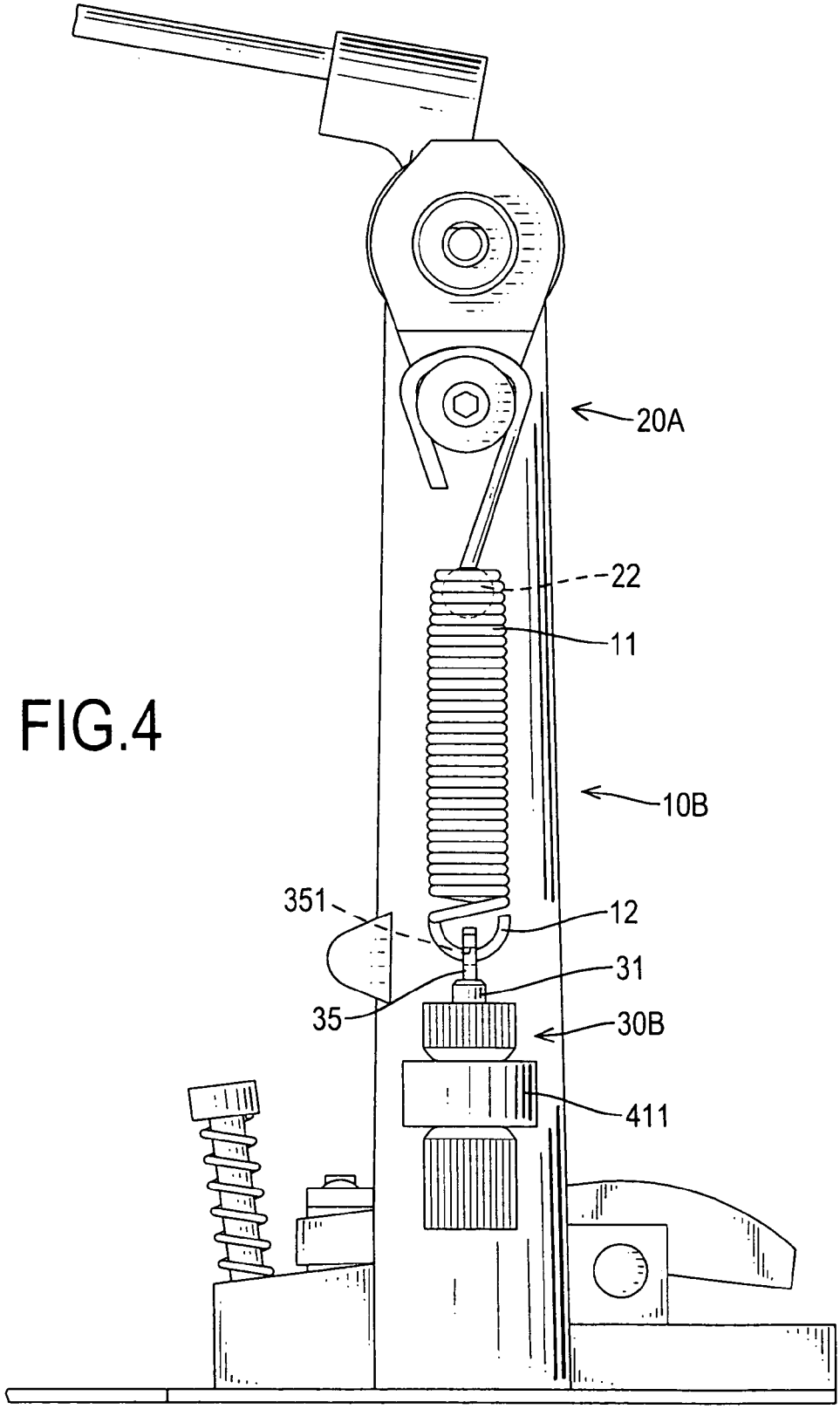
FIG. 4 is a side view of a second embodiment of the pedal device in accordance with the present invention.

With reference to FIG. 4, a second embodiment of the pedal device in accordance with the present invention has the spring (10B) having a lifting lug (12) formed at the lower end. The screw bolt (11) has an extension portion (35) formed in the top, and an aperture (351) is defined through the extension portion (35) and the lifting lug (12) hooks through the aperture (351). The other features are the same as those in the first embodiment.

The connection of the upper end of the spring (10B) with the sling hook (20A) is the same as that in the first embodiment. The knob (22) of the sling hook (20A) is embedded in the mounting portion. The second embodiment has an improvement compared to the conventional pedal device.

Figure 5:
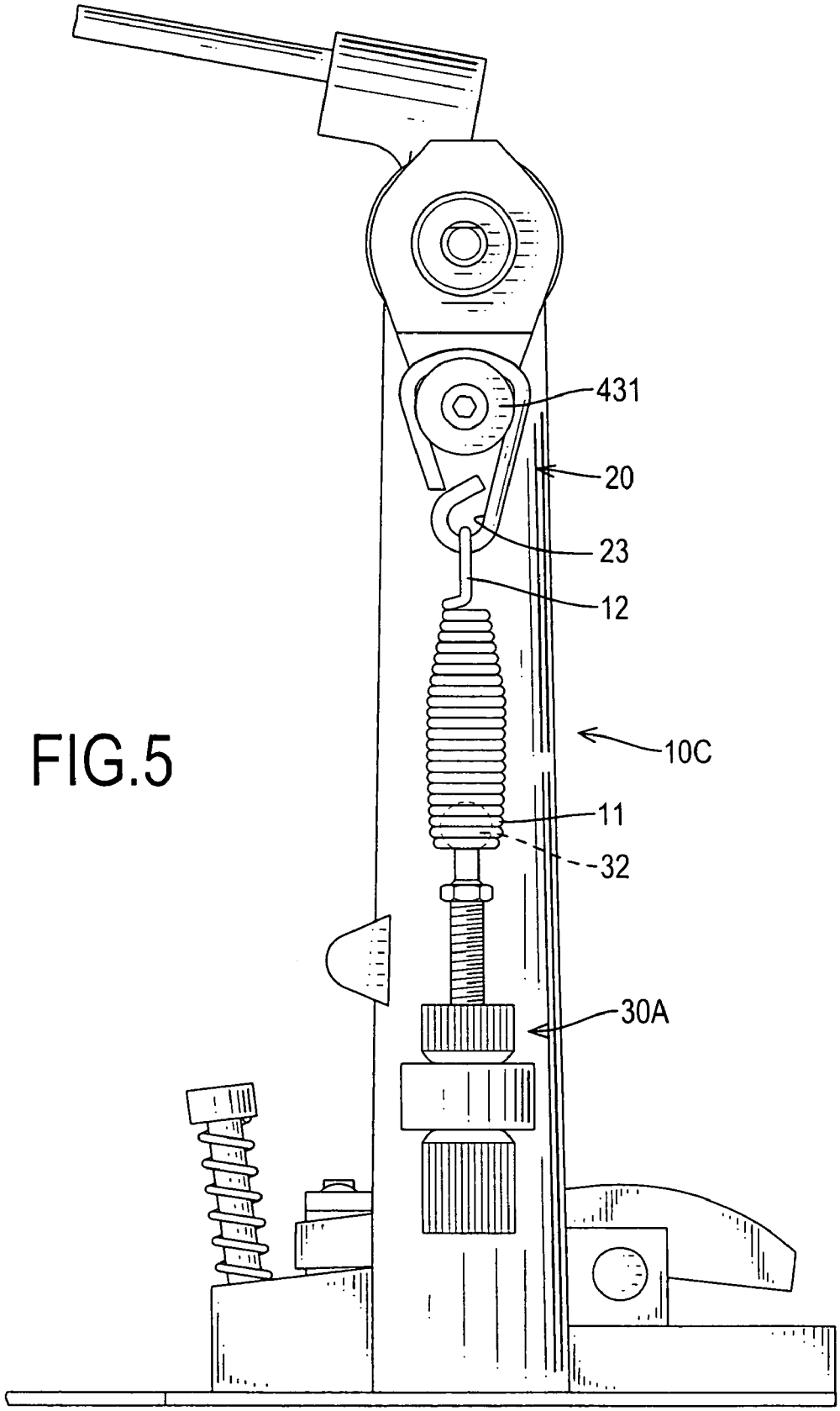
FIG. 5 is a side view of a third embodiment of the pedal device in accordance with the present invention.
Figure 6:
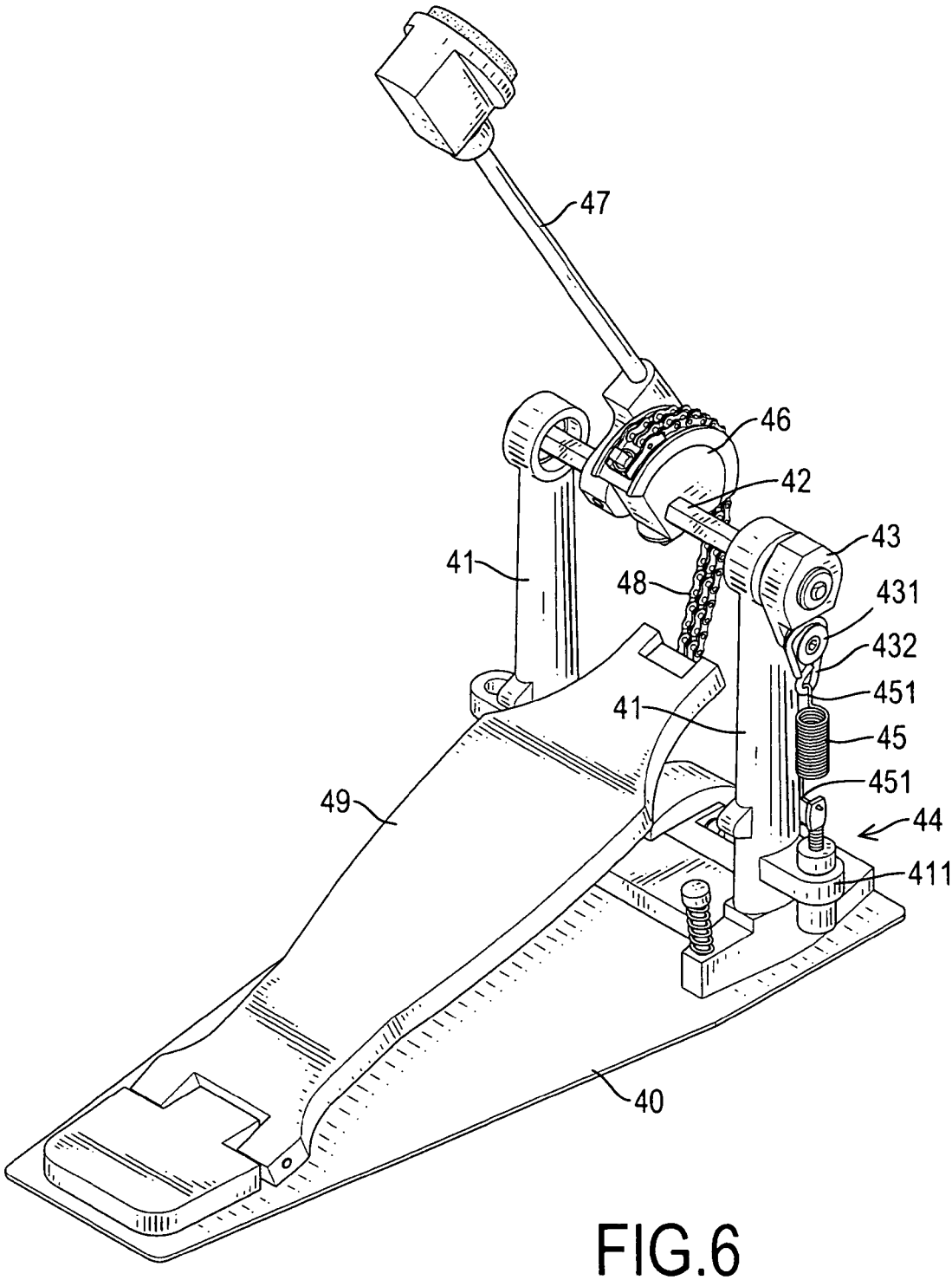
FIG.6 PRIOR ART
FIG. 6 is a perspective view of a conventional pedal device in accordance with the prior art.

With reference to FIG. 5, a third embodiment of the pedal device in accordance with the present invention, the upper end of the spring (10C) has a lifting lug (12), and the sling hook (20B) is bent to form a hole (23) through which the lifting lug (12) hooks. The other features are the same as those in the first embodiment.

The connection of the lower end of the spring (10C) to the sling hook (20) is the same as that in the first embodiment. The knob (32) on the screw bolt (31) is embedded in the mounting portion of the spring (10C). The third embodiment still has an improvement compared to the conventional pedal device.

It is to be understood, however, that even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A pedal device for a drum comprising a base;

two posts mounted on the base;

a shaft mounted rotatably between the post and having two ends and one end of the shaft being a protruding end mounted through and protruding out from one of the posts;

an arm mounted on the protruding end of the shaft;

a wheel mounted rotatably on the arm;

a seat formed on the post corresponding to the arm;

a sway member mounted on the shaft;

a drumstick extending from the top of the sway member;

a chain mounted on the sway member and having a distal end;

a pedal connected with the distal end of the chain and mounted pivotally with the base;

a spring having an upper end, a lower end and a diameter gradually shortened at the upper and lower ends, which forms two mounting portions;

a sling hook hooking on the wheel and having a first knob formed on the sling hook and embedded coaxially in the mounting portion at the upper end of the spring; and a connection member mounted on the seat and having a second knob formed on the connection member and embedded coaxially in the mounting portion.

2. A pedal device for a drum comprising a base;

two posts mounted on the base;

a shaft mounted rotatably between the post and having two ends and one end of the shaft being a protruding end mounted through and protruding out from one of the posts;

an arm mounted on the protruding end of the shaft;

a wheel mounted rotatably on the arm;

a seat formed on the post corresponding to the arm;

a sway member mounted on the shaft;

a drumstick extending from the top of the sway member;

a chain mounted on the sway member and having a distal end;

a pedal connected with the distal end of the chain and mounted pivotally with the base;

a spring having an upper end, a lower end and a diameter;

a sling hook hooking on the wheel; and a connection member mounted on the seat; wherein the diameter of the spring gradually shortened at the upper end to form a mounting portion, and a lifting lug is formed at the lower end of the spring;

the sling hook includes a first knob formed on the sling hook and embedded coaxially in the mounting portion; and the connection member has an aperture defined through the connection member and through which the lifting lug hooks.

3. A pedal device for a drum comprising a base;

two posts mounted on the base;

a shaft mounted rotatably between the post and having two ends and one end of the shaft being a protruding end mounted through and protruding out from one of the posts;

an arm mounted on the protruding end of the shaft;

a wheel mounted rotatably on the arm;

a seat formed on the post corresponding to the arm;

a sway member mounted on the shaft;

a drumstick extending from the top of the sway member;

a chain mounted on the sway member and having a distal end;

a pedal connected with the distal end of the chain and mounted pivotally with the base;

a spring having an upper end, a lower end and a diameter;

a sling hook hooking on the wheel; and a connection member mounted on the seat; wherein the diameter of the spring gradually shortened at the lower end to form a mounting portion, a lifting lug is formed at the upper end;

the sling hook is bent to form a hole through which the lifting lug hooks; and the connection member includes a second knob formed on the connection member and embedded coaxially in the mounting portion.

* * * * *